US008544485B2

(12) United States Patent
Ko

(10) Patent No.: US 8,544,485 B2
(45) Date of Patent: Oct. 1, 2013

(54) STRUCTURE OF SELF-CLOSING COLLAPSIBLE UMBRELLA

(76) Inventor: Chin Sung Ko, Hemei Township, Changhua County (TW)

( * ) Notice: Subject to any disclaimer, the term of this patent is extended or adjusted under 35 U.S.C. 154(b) by 698 days.

(21) Appl. No.: 12/632,798

(22) Filed: Dec. 8, 2009

(65) Prior Publication Data

US 2011/0132416 A1 Jun. 9, 2011

(51) Int. Cl.
*A45B 19/08* (2006.01)
*A45B 25/14* (2006.01)
*A45B 25/16* (2006.01)

(52) U.S. Cl.
USPC ..... 135/25.4; 135/24

(58) Field of Classification Search
USPC ..... 135/15.1, 24, 25.1, 25.4, 25.41, 25.3
See application file for complete search history.

(56) References Cited

U.S. PATENT DOCUMENTS 4,548,222 A * 10/1985 Day ..... 135/24
5,058,613 A * 10/1991 Su et al. ..... 135/20.3
5,309,932 A * 5/1994 Chou et al. ..... 135/22
5,318,067 A * 6/1994 Day ..... 135/22
5,533,541 A * 7/1996 Cheng et al. ..... 135/22
7,389,784 B2 * 6/2008 Kuo ..... 135/24
2005/0257817 A1 * 11/2005 Kuo ..... 135/24
2010/0206347 A1 * 8/2010 Liu ..... 135/24

* cited by examiner

*Primary Examiner* — David Dunn
*Assistant Examiner* — Danielle Jackson
(74) *Attorney, Agent, or Firm* — Leong C. Lei

(57) ABSTRACT

A self-closing collapsible umbrella is disclosed and an example of a three-fold umbrella is described. The umbrella includes a central shaft including a first section that includes a handle carrying an actuation button. A positioning seat that receives a retention block arranged therein is provided between the first section and a second section of the shaft and between the second section and a third section of the shaft. As such, the umbrella is opened manually to have the second section extending and positioned by the retention block engaging an upper end of the first section, and the third section is positioned by being retained at the upper end of the second section. To close the umbrella, a collapsing ring is depressed to drive a rotation block of a control seat to release the engagement of the retention block. Collapsing springs arranged on umbrella ribs apply a force to retract the sections of the central shaft to thereby complete the collapse of the umbrella.

6 Claims, 8 Drawing Sheets

STRUCTURE OF SELF-CLOSING COLLAPSIBLE UMBRELLA

TECHNICAL FIELD OF THE INVENTION

The present invention generally relates to a collapsible umbrella, and more particularly to a structure of self-closing collapsible umbrella.

DESCRIPTION OF THE PRIOR ART

Conventional multi-fold umbrellas do not possess the function of self-closing. FIG. 1 of the attaching drawings shows a self-opening umbrella, which comprises various constituent components, including a handle 1, in which an operation/control mechanism 2 that is very complicated is received, and a multi-section central shaft 3 coupled to the handle 1. A runner 4 is fit over the central shaft 3. A crown 5 is mounted to a top end of the topmost section of the central shaft 3. Ribs 6, which are of multiple sections, are coupled to the runner 4 and the crown 5. Further, the central shaft 3 receives therein more than one spring 7 that is of an extreme length and powerful and that is connected inside the central shaft 3 to the runner 4 and the crown 5 and a pull rope mechanism 8 that cooperates with the operation/control mechanism 2.

The operation of the umbrella is illustrated in FIG. 1. When a button on the handle 1 is depressed in an umbrella collapsed condition, the operation/control mechanism 2 releases the retained engagement of the runner 4, whereby due to the action of returning of the spring 7, the multi-section central shaft 3 is extended and the multi-section ribs 6 are expanded so as to complete the opening of the umbrella (as shown in FIG. 2). Two steps are needed for closing the umbrella, and as shown in FIG. 2, the button of the handle 1 is actuated in an umbrella opened condition, the operation/control mechanism 2 releases the retained engagement of the pull rope mechanism 8 that is connected to the runner 4. Due to the action of returning of umbrella collapsing springs (not shown) arranged on the ribs 6, the multi-section ribs 6 are collapsed (as shown in FIG. 3). Afterwards, the multi-section central shaft 3 is manually compressed to form the umbrella collapsed condition as shown in FIG. 1.

The previously described umbrella is considered a self-opening umbrella, but it is only semi-automatic in closing the umbrella. Such a known umbrella requires a great number of constituent components and is very complicated in structure, making the manufacturing costs thereof very high. Further, the known umbrella includes one or two powerful spring so that a user or any person nearby may get hurt by the umbrella, if the umbrella is opened or closed in a careless manner. Apparently, such an umbrella structure is not an ideal one and further improvement is needed.

SUMMARY OF THE INVENTION

An object of the present invention is to provide a self-closing collapsible umbrella of which an example of a three-fold umbrella is given. The feature of the umbrella is that a positioning seat that receives a retention block arranged therein is provided between a first section and a second section of a central shaft of the umbrella and between the second section and a third section of the central shaft. The first shaft section has a lower end that receives therein a control seat comprising a rotation block and is fixed to a handle. To open the umbrella, the umbrella is expanded manually to have the second section extending and positioned by the retention block engaging an upper end of the first section, and the third section is positioned by being retained at the upper end of the second section. To close the umbrella, a collapsing ring is depressed to drive the rotation block of the control seat in order to release the engagement of the retention block. Collapsing springs arranged on umbrella ribs apply a force to retract the sections of the central shaft to thereby complete the collapse of the umbrella. As such, the structure is made simple and the operation is easy and safe, by which the drawbacks of requiring a large number of components and having a complicated structure of the conventional self-opening collapsible umbrellas, which often leads to high manufacturing costs, and the problems that one or two powerful springs are included in the conventional umbrellas, which often leads to undesired risk of hurting the user or other people, are overcome.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
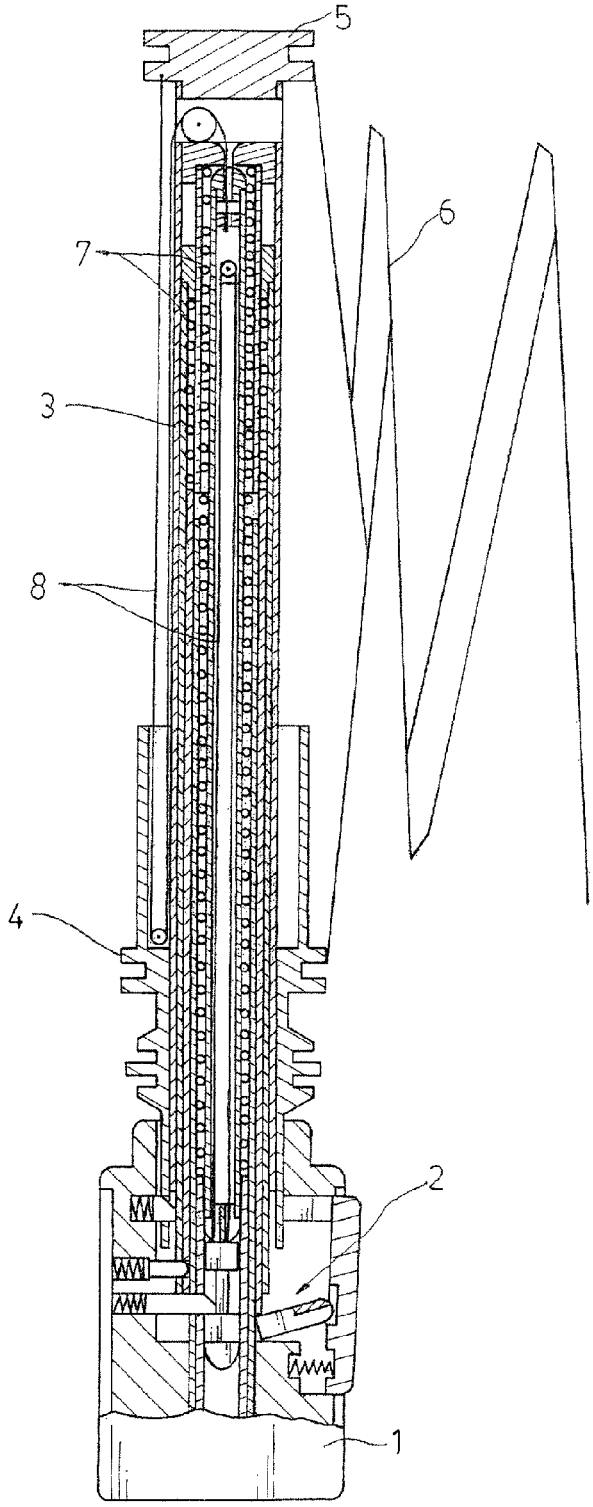
FIG. 1 (prior art)
FIGS. 1-3 are schematic view showing the structure and operation of a conventional self-opening collapsible umbrella.
Figure 2:
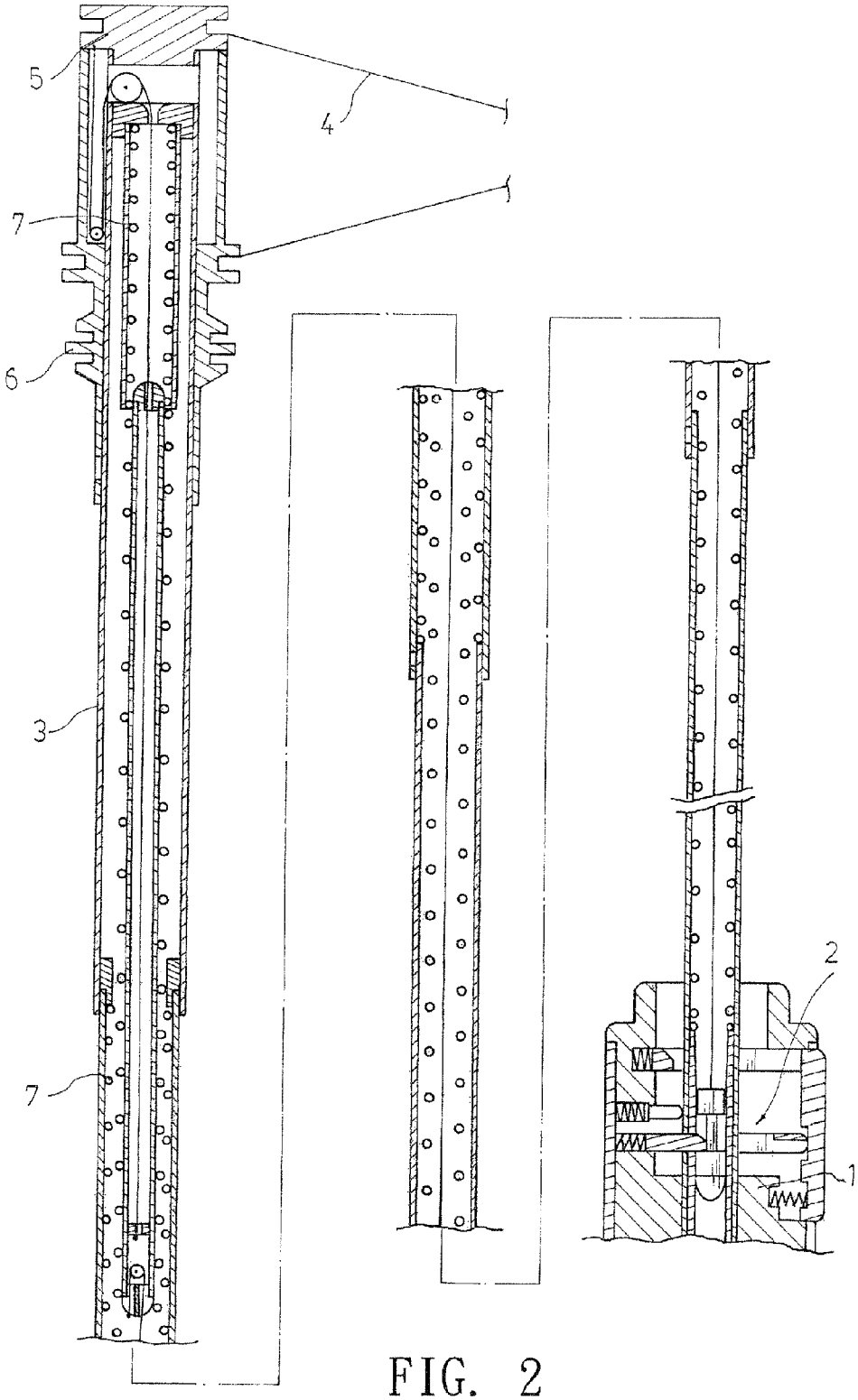
FIG. 2 (prior art)
Figure 3:
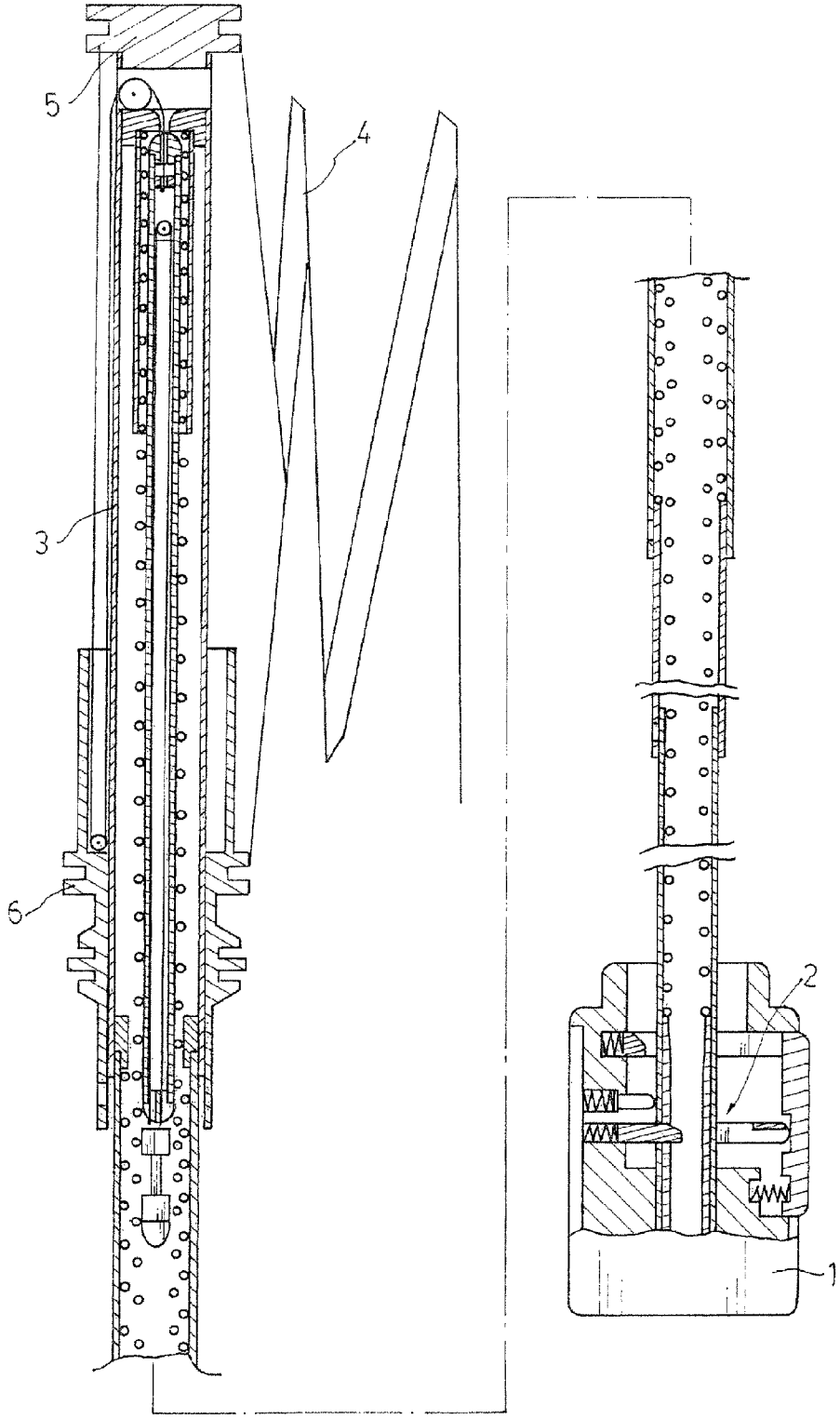
FIG. 3 (prior art)
Figure 4:
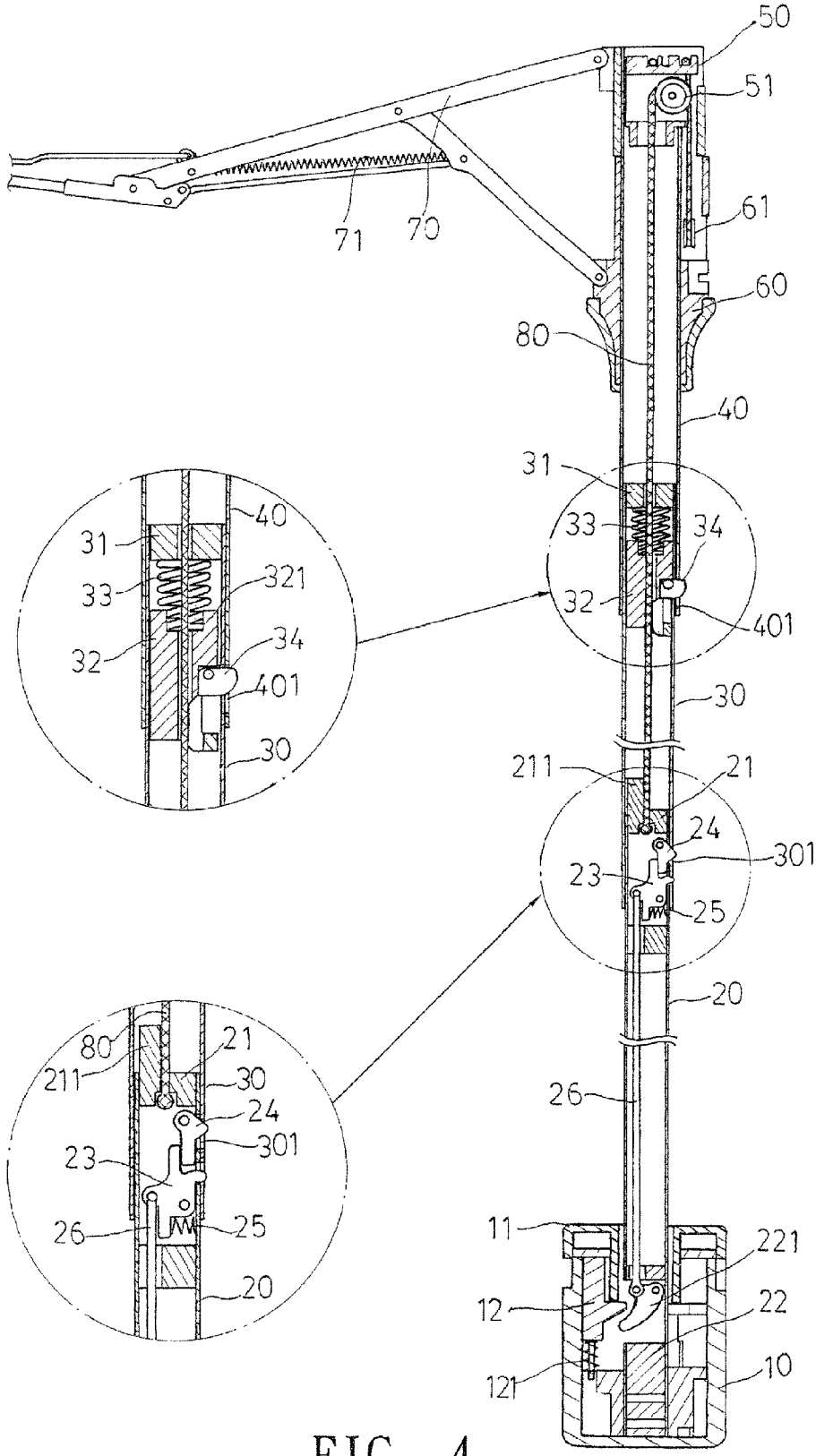
FIG. 4 is a cross-sectional view showing the structure and opening operation of a self-closing collapsible umbrella according to the present invention.

Referring to FIG. 4, the present invention will be described with reference to a preferred embodiment of a three-fold umbrella. The umbrella mainly comprises various constituent components, including a handle 10, a first section 20 of a central shaft, a second section 30 of the central shaft, a third section 40 of the central shaft, a crown 50, a runner 60, ribs 70, and a pull rope 80. The handle 10 is attached to a lower end of the first shaft section 20 and comprises a drive block 12 that is biased by a spring 121. The drive block 12 is set to abut a collapsing ring 11 that is fit to an upper end of the handle 10. The first shaft section 20 has an upper end that receives a positioning seat 21 fixed therein. The positioning seat 21 has an upper end forming a push block 211 and receives therein an operation block 23 and a retention block 24 that abut each other and are rotatable. A small spring 25 is provided to abut and bias one side of a lower end portion of the operation block 23. The first shaft section 20 has a lower end that receives a control seat 22 fixed therein. The control seat 22 receives therein a rotation block 221 that is engageable with a lower end of the drive block 12 of the handle 10. The first shaft section 20 receives therein a displacement bar 26 that has an upper end pivotally coupled to the operation block 23 and a lower end pivotally connected to the rotation block 221. The second shaft section 30 is fit outside the first shaft section 20 and has an upper end that receives therein a positioning seat 31. Also referring to FIGS. 6-9, the positioning seat 31 receives therein a movement block 32 that has an upper end portion forming a retention bar 321. The positioning seat 31 forms, in one side thereof, an open slot 311. The open slot 311 receives a rotatable retention block 34 pivotally mounted thereto. The movement block 32 has an upper end that cooperates with a spring 33 and is received into the positioning seat 31 through a lower end thereof to abut a rear side of the retention block 34 with the retention bar 321 located on a front side thereof received in the open slot 311 and a lower end of the retention bar 321 resting on an upper end of the retention block 34 to prevent the movement block 32 from falling out of the positioning seat 31. The third shaft section 40 is fit outside the second shaft section 30 and has an upper end that receives a crown 50 fixed therein. The crown 50 comprises a pulley 51 arranged therein. The runner 60 is fit outside the central shaft and has an upper portion having one side to which a pulley 61 is mounted. The ribs 70, which are of multiple sections, are coupled to the crown 50 and the runner 60. A collapsing spring 71 is mounted to a first section of each rib. The pull rope 80 has an end fixed to the upper end portion of the positioning seat 21 of the first shaft section 20, extending around the pulley 51 of the crown 50 and the pulley 61 of the runner 60 to have an opposite end thereof attached to an upper end of the crown 50.

Referring to FIG. 4, to use, the umbrella of the present invention is opened manually by pushing the runner 60 upward to have the ribs 70 expanded and the collapsing springs 71 stretched. At the same time, the second shaft section 30 is extended to have the a retention hole 301 formed in one side of the lower end portion thereof engaging the retention block 24 that is arranged in the upper end of the first shaft section 20. The retention block 24 is fixed and not rotated by being abutted by the operation block 23 that is biased by the small spring 25 so that the second shaft section 30 that is extended can be properly positioned. The operation block 23 also drives the displacement bar 26 upward, making the rotation block 221 that is arranged in the lower end of the first shaft section 20 setting an end thereof to abut against the lower end of the drive block 12. The third shaft section 40 is extended to have a retention hole 401 formed in one side of the lower end portion thereof engaging the retention block 34 that is arranged in the upper end of the second shaft section 30 and the retention block 34 is fixed and not rotated by being abutted by the movement block 32 that is biased by the spring 33 so that the third shaft section 40 that is extended can be properly positioned.

Figure 5:
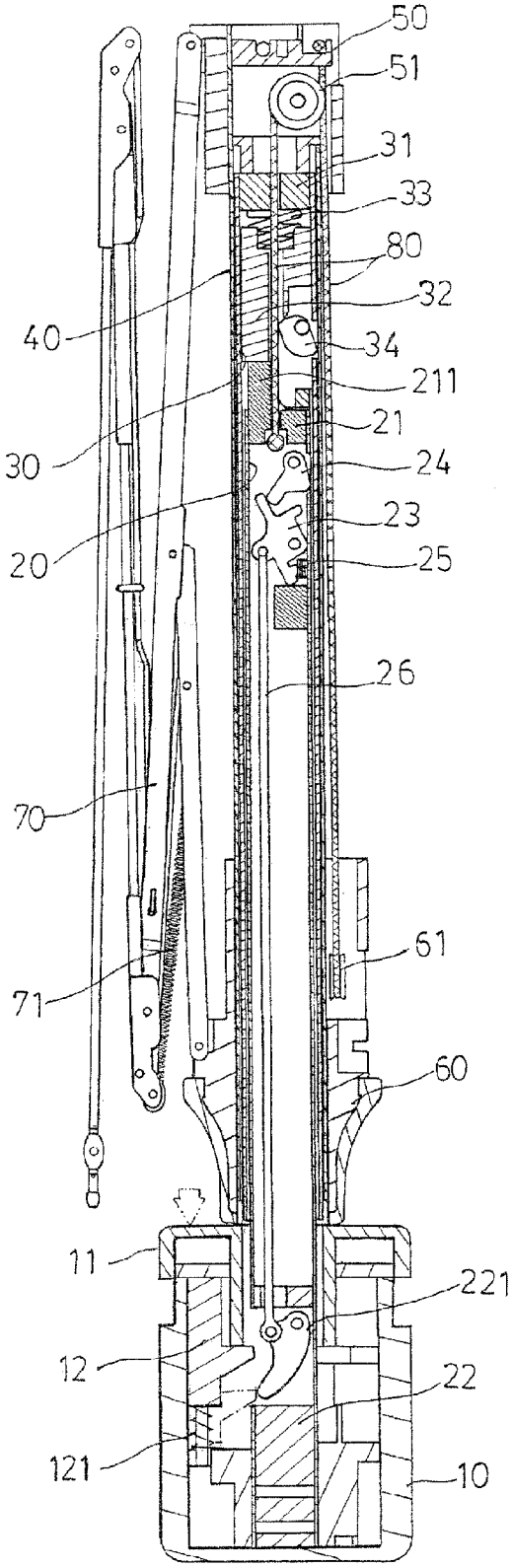
FIG. 5 is a schematic view showing the structure and closing operation of the self-closing collapsible umbrella of the present invention.
Figure 6:
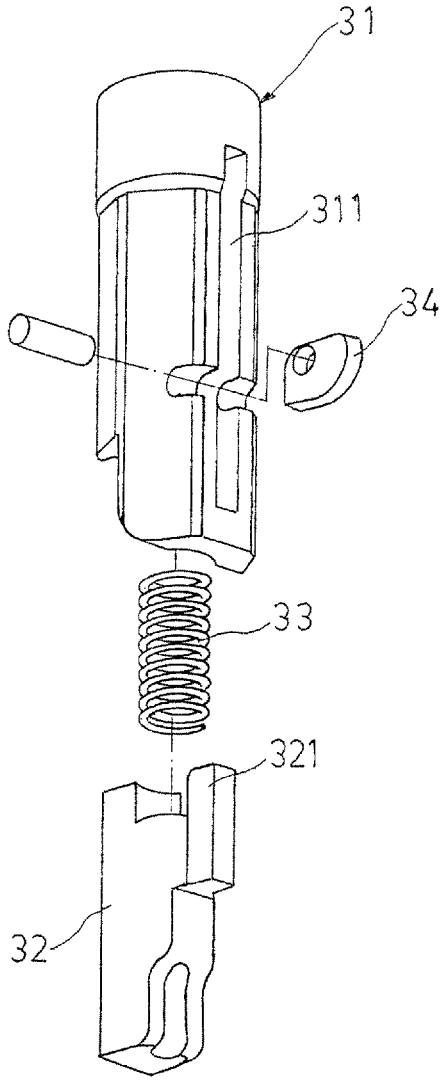
FIGS. 6-9 show a positioning seat of the self-closing collapsible umbrella of the present invention.
Figure 7:
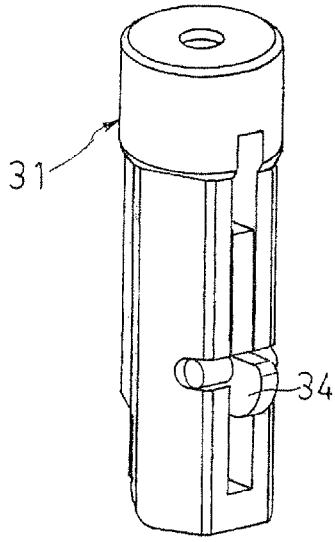
Figure 8:
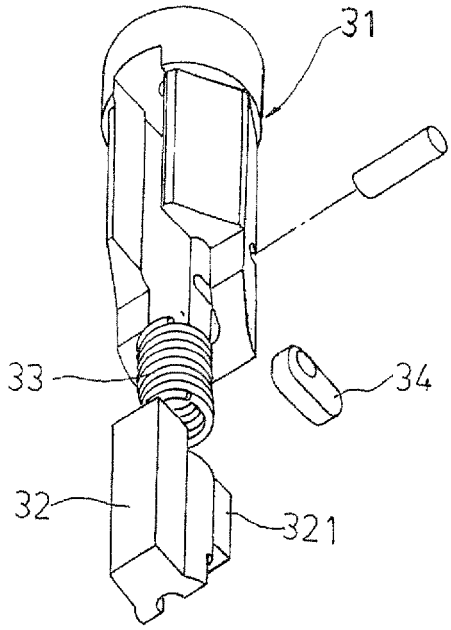
Figure 9:
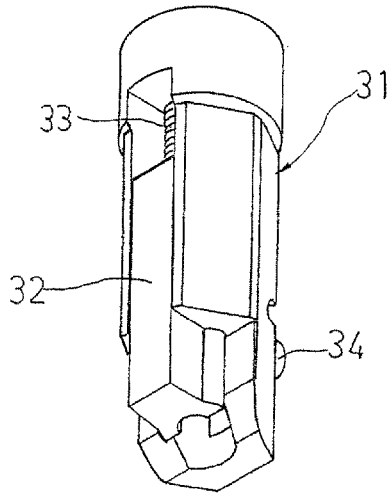

Referring to FIG. 5, to close the umbrella, the collapsing ring 11 mounted on the handle 10 is depressed to move the drive block 12 downward and the rotation block 221 is pushed sideways in a rightward direction. The rotation block 221 that is so caused to rotate drives the displacement bar 26 downward to cause rotation of the operation block 23 of the first shaft section 20 thereby compressing the small spring 25 and releasing abutting engagement of the operation block 23 with the retention block 24. The retention force between the retention block 24 and the retention hole 301 of the second shaft section 30 is thus released. The ribs 70 are acted upon by the returning force of the stretched collapsing springs 71 to cause the runner 60 to move downward and the second shaft section 30 retracting back toward the first shaft section 20. The movement block 32 arranged inside the positioning seat 31 of the second shaft section 30 is pushed by the push block 211 formed on the upper end of the positioning seat 21 of the first shaft section 20 to compress the spring 33 and to move upward, thereby releasing the abutting engagement thereof with the retention block 34. The retention force between the retention block 34 and the retention hole 401 of the third shaft section 40 is thus released and the third shaft section 40 is allowed to retracted back toward the second shaft section 30 to complete the self-closing operation of the umbrella.

Figure 10:
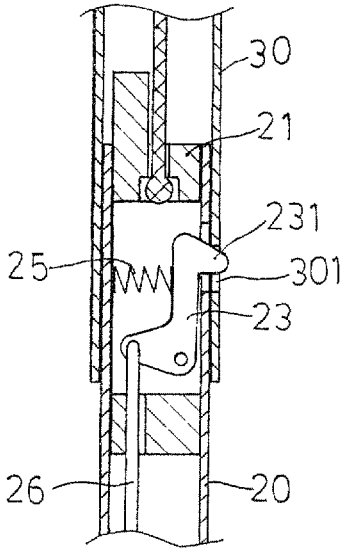
FIGS. 10 and 11 show another embodiment of a positioning seat of a first section of a central shaft of the self-closing collapsible umbrella of the present invention.
Figure 11:
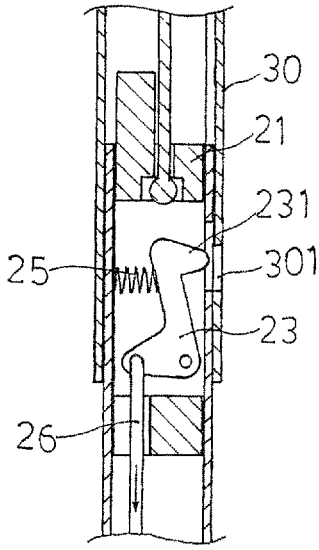

Referring to FIGS. 10 and 11, a modified embodiment of the positioning seat inside the first shaft section of the umbrella of the present invention is shown, wherein the positioning seat 21 of the first shaft section 20 receives therein only an operation block 23 that forms a retention projection 231 on a front portion of an upper end thereof and has a rear portion of a lower end pivotally connected to a displacement bar 26. The retention projection 231 has a rear side that is biased by a small spring 25. To open the umbrella, after the second shaft section 30 is extended, the retention projection 231 engages a retention hole 301 formed in one side of a lower end portion of the second shaft section 30 to properly position the extended second shaft section 30. To close the umbrella, the displacement bar 26 is driven downward to cause the rotation of the operation block 23 and compress the small spring 25 so as to release the retention force between the retention block 24 and the retention hole 301 of the second shaft section 30.

It is understood that the structure of the self-closing collapsible umbrella according to the present invention is not limited to the application to a three-fold umbrella and may also be equally applicable to outer multi-fold umbrellas, such as a four-fold umbrella, a five-fold umbrella, or a six-fold umbrella.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A self-closing collapsible umbrella comprising a handle, a first shaft section, a second shaft section, and a third shaft section of a central shaft, a crown, a runner, ribs, and a pull rope, wherein a first positioning seat that receives a first retention block therein is provided between the first and the second shaft sections and a second positioning seat that receives a second retention block therein is provided between the second and the third shaft sections, the first shaft section having a lower end that receives therein a control seat that comprises a rotation block and that is fixed to the handle, the rotation block being rotatable between a first position and a second position and being coupled to the first retention block of the first positioning seat, whereby when the rotation block is at the first position, the first retention block is set in engagement with a retention hole defined in the second shaft section so as to retain the second shaft section in an expanded position with respect to the first shaft section and when the rotation block is at the second position, the first retention block disengages from the retention hole of the second shaft section so as to release the second shaft section from the first shaft section, the third shaft section having an upper end to which the crown carrying a pulley is mounted, the runner being fit outside the central shaft and having an upper end portion having one side to which a pulley is mounted, the ribs being coupled to the crown and the runner and each provided with a collapsing spring, the pull rope having an end fixed to an upper end of the first positioning seat of the first shaft section and extending around the pulley of the crown and the pulley of the runner to have an opposite end attached to an upper end of the crown.

2. The self-closing collapsible umbrella according to claim 1, wherein the first positioning seat has an upper end forming push block and receives therein an operation block and the first retention block that abut each other and are rotatable, a small spring abutting and biasing one side of a lower end of the operation block, the control seat receiving therein the rotation block that is engageable with a lower end of a drive block of a collapsing ring of the handle, the first shaft section receiving therein a displacement bar that has an upper end pivotally coupled to the operation block and a lower end pivotally connected to the rotation block.

3. The self-closing collapsible umbrella according to claim 1, wherein the second shaft section is fit outside the first shaft section and has an upper end that receives therein the second positioning seat, the second positioning seat receiving therein a movement block that has an upper end portion forming a retention bar, the second positioning seat forming an open slot in one side thereof, the open slot receiving the second retention block pivotally mounted thereto, the movement block having an upper end that cooperates with a spring and is received into the second positioning seat through a lower end thereof to abut a rear side of the second retention block with the retention bar located on a front side thereof received in the open slot and a lower end of the retention bar resting on an upper end of the second retention block to prevent the movement block from falling out of the second positioning seat.

4. The self-closing collapsible umbrella according to claim 1, wherein the third shaft section is fit outside the second shaft section.

5. The self-closing collapsible umbrella according to claim 1, wherein the first retention block of the first positioning seat is an operation block that forms a retention projection on a front portion of an upper end thereof and has a rear portion of a lower end pivotally connected to a displacement bar, the retention projection having a rear side that is biased by a small spring.

6. The self-closing collapsible umbrella according to claim 1, wherein the self-closing collapsible umbrella is a multifold umbrella having more than three folds.

* * * * *